US007473862B2

(12) United States Patent
Seo

(10) Patent No.: US 7,473,862 B2
(45) Date of Patent: Jan. 6, 2009

(54) MOVABLE CONTACTOR OF CIRCUIT BREAKER AND FABRICATION METHOD FOR FINGER THEREOF

(75) Inventor: Jae-Kwan Seo, Chungcheongbuk-Do (KR)

(73) Assignee: LS Industrial Systems Co., Ltd., Seoul (KR)

( * ) Notice: Subject to any disclaimer, the term of this patent is extended or adjusted under 35 U.S.C. 154(b) by 0 days.

(21) Appl. No.: 11/870,665

(22) Filed: Oct. 11, 2007

(65) Prior Publication Data

US 2008/0088395 A1 Apr. 17, 2008

(30) Foreign Application Priority Data

Oct. 17, 2006 (KR) ..... 10-2006-0101071

(51) Int. Cl.
*H01H 3/46* (2006.01)
*H01H 11/00* (2006.01)

(52) U.S. Cl. ..... 200/400; 200/271; 200/273; 200/274; 335/196; 335/200; 29/622

(58) Field of Classification Search ..... 335/6, 335/15, 185, 189–192, 194, 196; 200/271–274, 200/400; 29/622; 218/146
See application file for complete search history.

(56) References Cited

U.S. PATENT DOCUMENTS 4,242,577 A * 12/1980 Maier et al. ..... 200/400
4,580,021 A * 4/1986 Fujikake ..... 200/400
5,924,554 A * 7/1999 Dosmo et al. ..... 200/400
6,225,884 B1 * 5/2001 Fischer et al. ..... 335/202
2006/0086693 A1 4/2006 Yeon
2006/0119455 A1 6/2006 Park
2006/0131145 A1 6/2006 Suh
2007/0075047 A1 4/2007 Oh
2007/0075808 A1 4/2007 Ahn

OTHER PUBLICATIONS

U.S. Appl. No. 11/870,763 to Yang et al., filed Oct. 11, 2007.
U.S. Appl. No. 11/870,704 to Ahn et al., filed Oct. 11, 2007.

* cited by examiner

*Primary Examiner*—Ramon M Barrera
(74) *Attorney, Agent, or Firm*—Greenblum & Bernstein, P.L.C.

(57) ABSTRACT

A movable contactor of a circuit breaker, comprising: a cage for angularly rotating with one side as a axis; a plurality of fingers disposed at the cage, including a path body portion having a predetermined thickness and having one end of an inclined plane, a wire connecting portion extending from one end of the path body portion with steps so as to have a certain area and having one horizontal plane, and an arc discharge portion extending from another end of the path body portion with a predetermined length so as to induce the discharge of the arc; and terminals each coupled to each of the fingers and for contacting or being separated from a fixed contactor according to the angular-rotation of the cage. Accordingly, the fabrication process for fingers is facilitated and the material cost necessary to fabricate the fingers can be reduced, thereby reducing the fabrication cost.

11 Claims, 5 Drawing Sheets

MOVABLE CONTACTOR OF CIRCUIT BREAKER AND FABRICATION METHOD FOR FINGER THEREOF

RELATED APPLICATION

The present disclosure relates to subject matter contained in priority Korean Application No. 10-2006-101071, filed on Oct. 17, 2006, which is herein expressly incorporated by reference in its entirety.

BACKGROUND OF THE INVENTION

1. Field of the Invention

The present invention relates to a movable contactor of a circuit breaker, and more particularly, to a movable contactor of a circuit breaker which can minimize manufacturing cost and to a fabrication method for finger thereof.

2. Description of the Background Art

In general, a circuit breaker is connected to a circuit that a current flows to make the current flow in the circuit in normal state. And, when a fault current (or abnormal current) occurs in the circuit, the circuit breaker breaks the fault current, thereby protecting the circuit and its device.

Such circuit breakers include a casing having a receiving space therein, a plurality of fixed contactors having a fixed contact and fixed inside the casing, a plurality of movable contactors having a movable contact formed to contact the fixed contact and disposed inside the casing so as to perform a relative motion with respect to the fixed contactor, a driving unit for driving the movable contactors, and a detecting unit for detecting overcurrent, a fault current, etc. and for driving the driving unit.

One side of the movable contactor is connected to outlet-side fixed contacts of the fixed contactor, and another side of the movable contactor is connected to or separated from inlet-side fixed contacts of the fixed contactor according to a movement of the movable contactor.

And, a plurality of arc extinguishing rooms are disposed above the movable contactor so as to exhaust the arc generated when the movable contactor contacts or is separated from the fixed contactor.

Such circuit breakers are operated as follows:

First, in normal state, the movable contactor is connected to the inlet-side fixed contact of the fixed contactor. Then, a power is supplied through the inlet-side fixed contacts of the fixed contactor, and flows in an internal path of the movable contactor. The power flowing in the internal path of the movable contactor flows to a load unit through the outlet-side fixed contacts of the fixed contactor.

And, if the detecting unit detects overcurrent and a fault current, the driving unit is driven by an internal operation mechanism. While the movable contactors angularly rotate according to the driving unit's motion, the movable contacts of the movable contactors and the inlet-side fixed contacts of the fixed contactors are separated from each other, thereby breaking the current's flow.

The movable contactor includes a plurality of fingers for contacting or being separated from the inlet-side fixed contacts of the fixed contactor, and lead wires each coupled to an end of each of the fingers and connected to the outlet-side fixed contacts of the fixed contactor so as to apply the current flowing to the fingers to the load unit.

Meanwhile, the finger of the movable contactor may be formed of an expensive copper material having excellent conductivity and processability.

Accordingly, to reduce the manufacturing cost of the movable contactor, minimization of the material loss is the major issue when fabricating the fingers.

SUMMARY OF THE INVENTION

Therefore, it is an object of the present invention to provide a movable contactor of a circuit breaker which can minimize manufacturing cost, and a fabrication method for finger thereof.

To achieve this and other advantages and in accordance with the purpose of the present invention, as embodied and broadly described herein, there is provided a movable contactor of a circuit breaker, comprising: a cage for angularly rotating with one side as a axis; a plurality of fingers disposed at the cage, including a path body portion having a predetermined thickness and having one end of an inclined plane, a wire connecting portion extending from one end of the path body portion with steps so as to have a certain area and having one horizontal plane, and an arc discharge portion extending from another end of the path body portion with a predetermined length so as to induce the discharge of the arc; and terminals each coupled to each of the fingers and for contacting or being separated from a fixed contactor according to the angular-rotation of the cage.

Further, there is provided a fabrication method for a finger of a movable contactor, comprising: preparing a board having a predetermined thickness and width; when fabricating the finger in a manner that a lengthwise direction of a finger is placed in a width direction of the board and a portion of the board is cut in a lengthwise direction of the board, cutting a portion of the board such that an end of an arc discharge portion of the finger can be overlapped to a path body portion of an adjacent finger, and each of both side surfaces of the path body portion of the finger can contact a side surface of the path body portion of the adjacent finger; forming a wire connecting portion for connecting a wire by pressing a portion of one end of the cut finger; and forming a filling portion for filling the cut portion overlapped by pressing a portion of another end of the cut finger.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Description will now be given in detail of the movable contactor of a circuit breaker of the present invention and a fabrication method for a finger of the movable contactor, examples of which are illustrated in the accompanying drawings.

Figure 1:
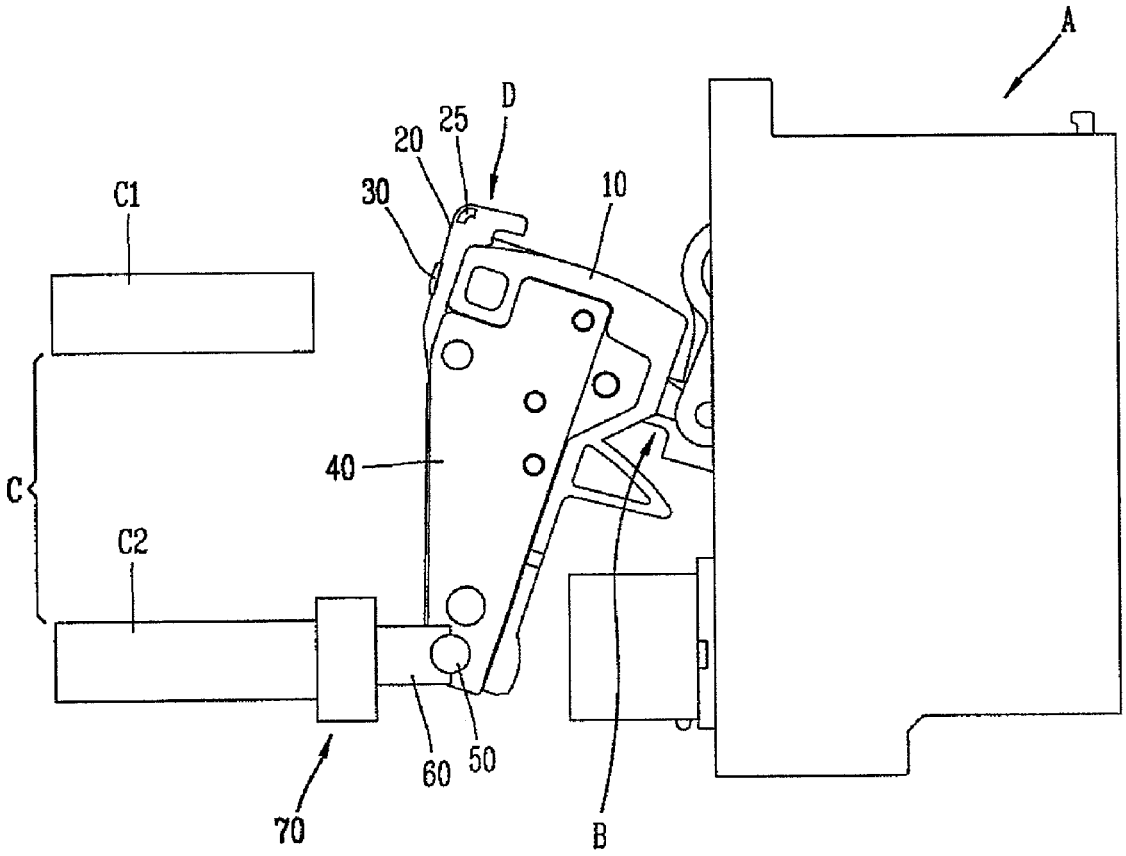
FIG. 1 is a side view showing a portion of a circuit breaker to which one embodiment of a movable contactor of a circuit breaker of the present invention is applied.
Figure 2:
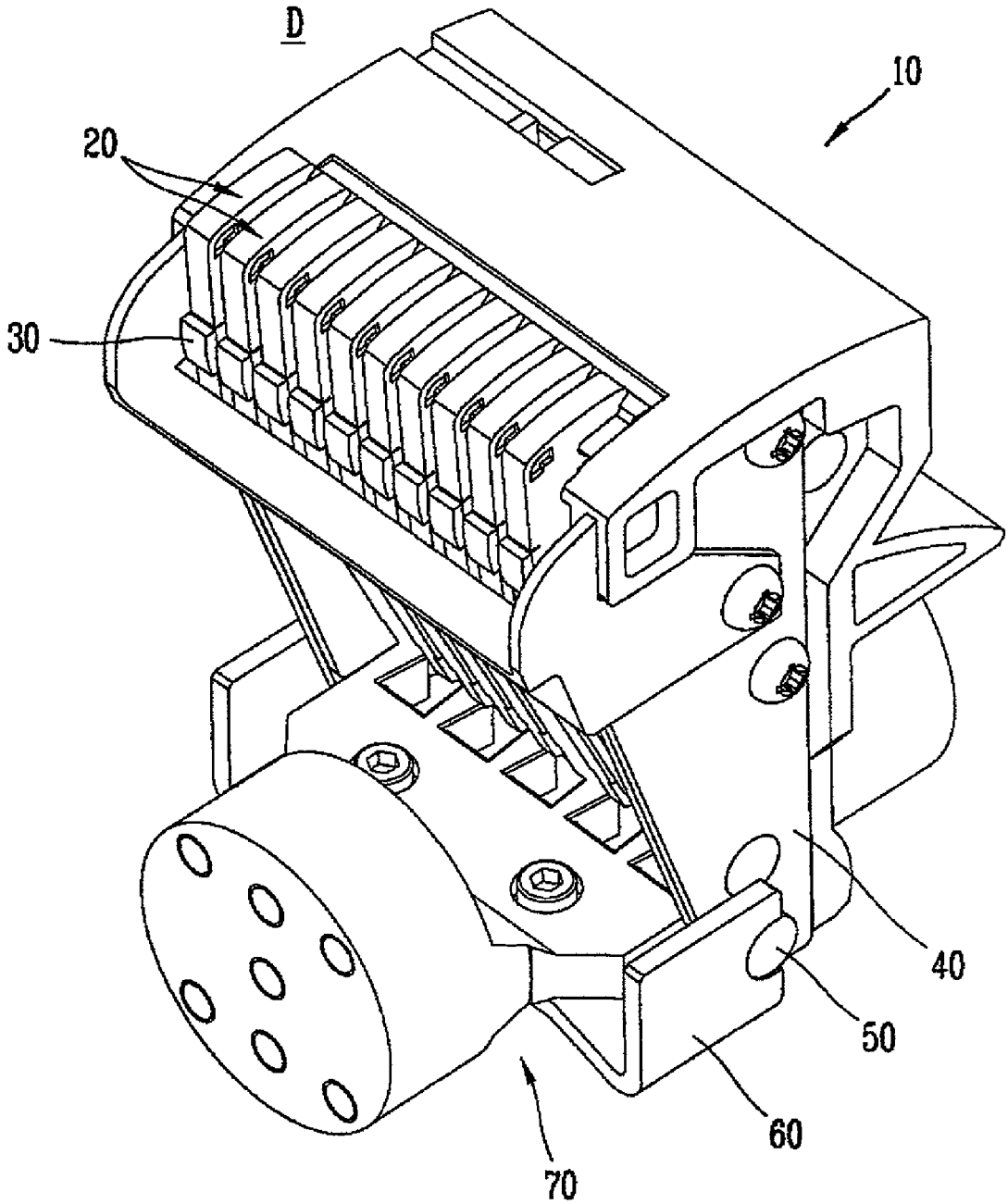
FIG. 2 is a perspective view showing one embodiment of a movable contactor of a circuit breaker of the present invention.

FIG. 1 is a side view showing a portion of a circuit breaker to which one embodiment of a movable contactor of a circuit breaker of the present invention is applied. FIG. 2 is a perspective view showing one embodiment of a movable contactor of a circuit breaker of the present invention.

As shown in drawings, a movable contactor D of the circuit breaker includes a cage 10 formed in a predetermined shape, a plurality of fingers 20 coupled at one side of the cage 10 to be disposed at a predetermined interval, contact terminals 30 each coupled to each of the fingers 20, side plates 40 each coupled to both sides of the cage 10 to cover the fingers 20, and a shaft (hinge shaft) 50 coupled to a lower end of the side plate 40 or of the cage 10.

A bracket 60 having a certain shape is coupled to the lower end of the cage 10 so as to be movable in a certain angle centering around the shaft 50. A load-side connecting terminal 70 is coupled to the bracket 60 so as to be disposed above the bracket 60.

The load-side connecting terminal 70 is connected to outlet-side fixed contacts C2 of a fixed contactor C of the circuit breaker. The fingers 20 and the load-side connecting terminal 70 are connected by lead wires (not shown).

A connecting unit B connected to a driving unit A of the circuit breaker is disposed at one side of the cage 10. The connecting unit B is disposed in an opposite direction to a location where the fingers 20 are positioned.

As the driving unit A pulls or pushes the connecting unit B, the cage 10 is angularly rotated centering around the shaft 50. Then, each of the contact terminals 30 coupled to each of the fingers 20 may contact or be separated from the inlet-side fixed contacts C1 of the fixed contactor C.

A plurality of arc extinguishing rooms (not shown) are disposed above the cage 10 of the movable contactor, that is, above the fingers 20 for discharging the arc generated when the contact terminals 30 of the fingers 20 contact or are separated from the inlet-side fixed contacts C1 of the fixed contactor C. A plurality of grids (not shown) are arranged in each of the arc extinguishing rooms in a layered shape such that the arc can be induced to chill and to be extinguished.

Figure 3:
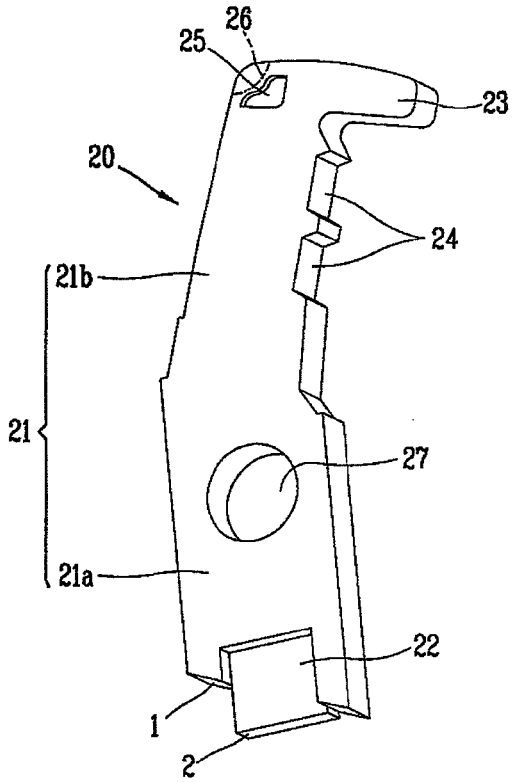
FIGS. 3 and 4 are respectively a perspective view and a cross-sectional view each showing one embodiment of a finger of a movable contactor of a circuit breaker of the present invention.
Figure 4:
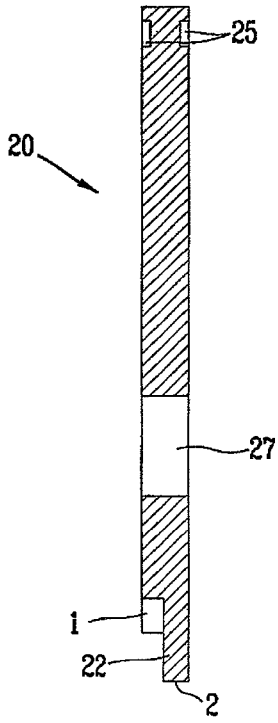

Referring to FIGS. 3 and 4, the finger 20 includes a path body portion 21 having a predetermined thickness and having one end of an inclined plane 1, a wire connecting portion 22 extending from one end of the path body portion 21 with steps so as to have a certain area and having one horizontal plane 2, and an arc discharge portion 23 extending from another end of the path body portion 21 with a predetermined length so as to induce the discharge of the arc.

The path body portion 21 includes a width portion 21*a* having a predetermined width and length, and an inclined portion 21*b* extending from the width portion 21*a* having a predetermined length with an inclination. An end surface of the width portion 21*a* is formed as the inclined plane 1, and the arc discharge portion 23 having a predetermined length is extended from (one side surface of) an end of the inclined portion 21*b*. The inclined plane 1 of the path body portion 21 is formed to have an inclination based on both side surfaces of the width portion 21*a*. And, spring seats 24 having a predetermined width and depth are formed at a side surface of the path body portion 21 so as to be adjacent to the arc discharge portion 23. The spring seat 24 supports one side of the spring, and thus the spring elastically pushes the finger 20.

A portion of the wire connecting portion 22 is protruded from the inclined plane 1 of the path body portion 21, thereby forming a horizontal lower plane 2. Other portions of the wire connecting portion 22, except the horizontal lower plane 2, are disposed at the path body portion 21.

Preferably, the wire connecting portion 22 is formed in a rectangular shape.

Preferably, the wire connecting portion 22 is formed at one surface of the path body portion 21 with steps.

The wire connecting portion 22 of the finger 20 is connected to one end of a lead wire (not shown). Preferably, the lead wire is coupled by soldering or welding.

A pressed recess 25 is formed on both surfaces of one side of the path body portion 21. As the pressed recesses 25 are formed, portions corresponding to the volume of the pressed recesses 25 are moved to fill an overlapped-cut portion 26 formed at a corner of the path body portion 21, thereby forming a protruding curved shape. When a board having a predetermined width and length is cut by a press to fabricate the finger 20, the finger 20 is cut by being overlapped with an adjacent finger 20. Here, a corner of one side of the path body portion 21 is overlapped, and a portion thereof is cut, thereby forming the overlapped-cut portion 26. Since the overlapped-cut portion 26 forms the pressed recess 25 by pressing the portion of the path body portion 21, the volume corresponding to that of the pressed recesses 25 fills the overlapped-cut portion 26. The overlapped-cut portion 26 is disposed in an opposite direction to a position where the arc discharge portion 23 is disposed. And, the pressed recess 25 is formed to be adjacent to the overlapped-cut portion 26.

Figure 5:
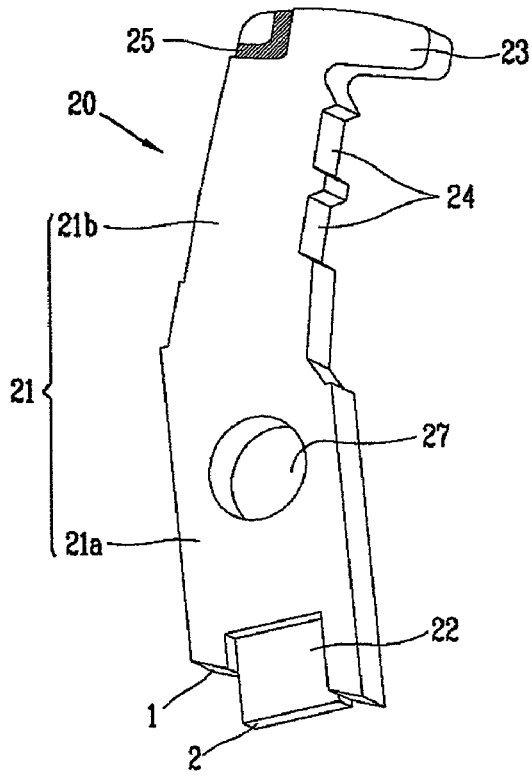
FIG. 5 is a perspective view showing another embodiment of a finger of a movable contactor of a circuit breaker of the present invention.

The pressed recess 25 is disposed in the path body portion 21. Further, the pressed recess 25, as shown in FIG. 5, may have an opened shape so as to be communicated with an edge of the path body portion 21.

The contact terminal 30 is coupled to a side surface in an opposite direction to the position where the spring seat 24 of the finger 20 is disposed. The contact terminal 30 is coupled to the finger 20 by welding or soldering.

An engaging hole 27 is penetratingly formed at the path body portion 21 of the finger 20.

The plurality of fingers 20 are arranged at one side of the cage 10 at a predetermined interval. The arc discharge portion 23 of the finger 20 is disposed above the cage 10, and the wire connecting portion 22 is disposed below the cage 10. Here, the contact terminal 30 coupled to the finger 20 is exposed to an outside.

One embodiment of the fabrication method for finger 20 of the movable contactor D will be described in detail.

First, a board is prepared to have a predetermined thickness and width.

Figure 6:
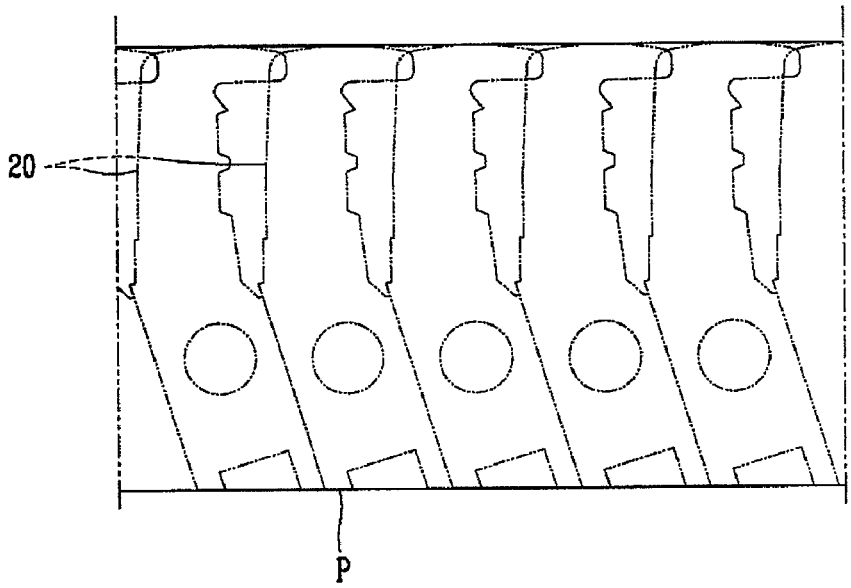
FIG. 6 is a plane view showing a fabrication method for a finger of a movable contactor of a circuit breaker of the present invention.
Figure 7:
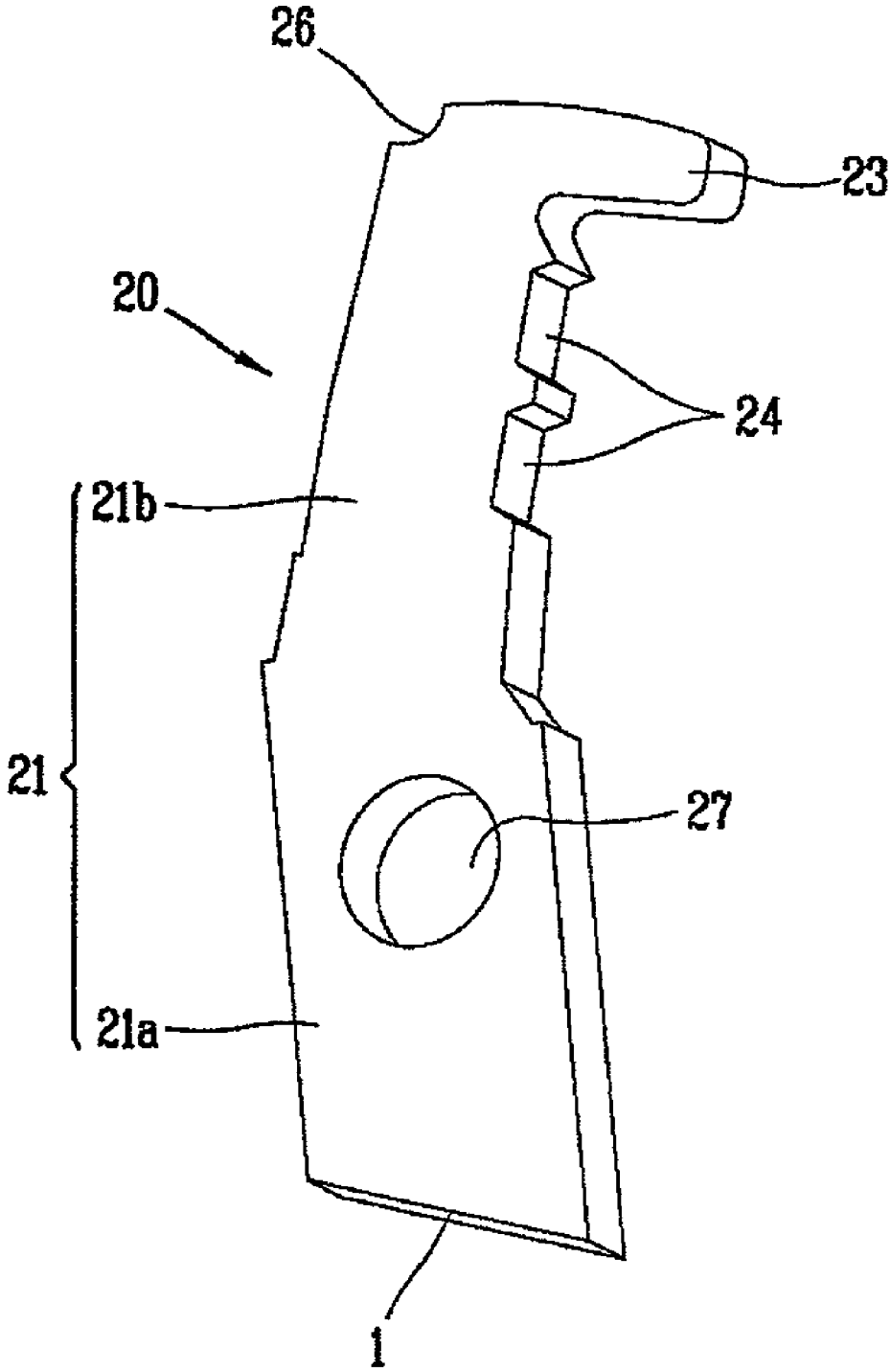
FIG. 7 is a perspective view showing a finger cut by a fabrication method of a finger of a movable contactor of a circuit breaker of the present invention.

As shown in FIG. 6, the lengthwise direction of the finger 20 is disposed in a width direction of the board P, and then a portion of the board P is cut in a lengthwise direction of the board P, thereby fabricating the fingers 20 as shown in FIG. 7. Here, the fingers 20 are cut in a state that the end of the arc discharge portion 23 of the finger 20 is overlapped with a path body portion 21 of an adjacent finger 20, and both side surfaces of the path body portion 21 of the finger 20 contact each side surface of the path body portion 21 of the adjacent finger 20. In addition, each end surface of the fingers 20, that is, the end surface of the arc discharge portion 23 is overlapped with the one end surface of the board. And, another end surface of the finger 20, that is, the inclined plane 1 forms another end surface of the board.

The wire connecting portion 22 connected to the lead wire is formed by pressing a portion of one end of the cut finger 20. And, the filling portion for filling the overlapped-cut portion 26 is formed, while the pressed recess 25 is formed by pressing a portion of another end of the cut finger 20.

The wire connecting portion 22 and the pressed recess 25 may be formed simultaneously or sequentially.

Hereinafter, the operation effect of the movable contactor of the circuit breaker of the present invention and a fabrication method for a finger thereof will be described.

First, when a power (current) is normally supplied to the circuit breaker, the contact terminals 30 of the movable contactor contact inlet-side fixed contacts C1 of the fixed contactor C. Here, the power flows to the fingers 20, lead wire and the load-side connecting terminal 70 through the inlet-side fixed contacts C1 of the fixed contactor C. The power flowing through the load-side connecting terminal 70 is transferred to the load unit (not shown) through the outlet-side fixed contacts C2 of the fixed contactor C.

When an abnormal current is detected, the movable contactor is angularly rotated centering around the shaft 50 by an operation of the driving unit A, and the contact terminals 30 each coupled to each of the fingers 20 are separated from the inlet-side fixed contacts C1 of the fixed contactor C. Accordingly, the abnormal current is prevented from flowing to the load unit.

Further, the arc generated when the finger 20 of the movable contactor contacts/is separated from the fixed contactor C is induced along the arc discharge portion 23 of the finger 20, and then is discharged by the arc extinguishing room.

Meanwhile, the fingers 20 of the movable contactor are fabricated by cutting a portion of the board having a predetermined thickness and width, thereby facilitating the fabrication process and reducing the loss of the board. That is, the fingers 20 are fabricated by cutting the portion of the board such that the side surface of the path body portion 21 of the adjacent finger 20 contacts the board, and a portion of the arc discharge portion 23 is overlapped with the adjacent finger 20, thereby minimizing the number of remaining strips of the board after fabricating the fingers 20, thus to remarkably reduce the loss of the material.

Accordingly, the material cost necessary to fabricate the fingers 20 can be reduced, thereby reducing the fabrication cost.

The movable contactor D is fabricated by being coupled to the fingers 20, thereby reducing the fabrication cost of the movable contactor D and thus to enhance price competitiveness.

As the present features may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. A movable contactor of a circuit breaker, comprising:

a cage that angularly rotates with one side as an axis;

a plurality of fingers disposed at the cage, including a path body portion having a predetermined thickness and having one end including an inclined plane, a wire connecting portion extending from the one end of the path body portion, the one end having steps configured to have a certain area and having one horizontal plane, and an arc discharge portion extending from another end of the path body portion, the arc discharge portion having a predetermined length so as to induce the discharge of the arc; and terminals coupled to each of the fingers, the terminals configured to contact or be separated from a fixed contactor according to the angular-rotation of the cage, wherein a portion of the wire connecting portion protrudes from the inclined plane of the path body portion, thereby forming a horizontal lower plane, and other portions of the wire connecting portion, except the horizontal lower plane, are disposed at the path body portion.

2. The movable contactor of claim 1, wherein the wire connecting portion is formed in a rectangular shape.

3. The movable contactor of claim 1, wherein the wire connecting portion is formed at one surface of the path body portion with the steps.

4. The movable contactor of claim 1, wherein a plurality of pressed recesses are formed on one side of the path body portion.

5. The movable contactor of claim 4, wherein the pressed recess is disposed in the path body portion.

6. The movable contactor of claim 4, wherein the pressed recess is formed to be opened so as to be communicated with an edge of the path body portion.

7. A movable contactor of a circuit breaker, comprising:

a cage that angularly rotates with one side as an axis;

a plurality of fingers disposed at the cage, including a path body portion having a predetermined thickness and having one end including an inclined plane, a wire connecting portion extending from the one end of the path body portion, the one end having steps configured to have a certain area and having one horizontal plane, and an arc discharge portion extending from another end of the path body portion, the arc discharge portion having a predetermined length so as to induce the discharge of the arc; and terminals coupled to each of the fingers, the terminals configured to contact or be separated from a fixed contactor according to the angular-rotation of the cage, wherein each pressed recess is formed on both surfaces of one side of the path body portion, and wherein as the pressed recesses are formed, portions corresponding to the volume of the pressed recesses are restored to a protruding curved shape by filling an overlapped-cut portion formed at a corner of the path body portion.

8. The movable contactor of claim 7, wherein the overlapped-cut portion is disposed in an opposite direction to a position where the arc discharge portion is disposed.

9. A fabrication method for a finger of a movable contactor, comprising:

preparing a board having a predetermined thickness and width;

when fabricating the finger in a manner that a lengthwise direction of a finger is placed in a width direction of the board and a portion of the board is cut in a lengthwise direction of the board, cutting a portion of the board such that an end of an arc discharge portion of the finger can be overlapped to a path body portion of an adjacent finger, and each of both side surfaces of the path body portion of the finger can contact a side surface of the path body portion of the adjacent finger;

forming a wire connecting portion that connects a wire by pressing a portion of one end of the cut finger; and forming a filling portion that fills the cut portion overlapped by pressing a portion of another end of the cut finger.

10. The method of claim 9, wherein the wire connecting portion and the filling portion are formed simultaneously.

11. The method of claim 9, wherein each end surface of the fingers is overlapped with an end surface of the board.

* * * * *